US005201568A

United States Patent [19]

Christensen, Jr.

[11] Patent Number: 5,201,568

[45] Date of Patent: Apr. 13, 1993

[54] FOOT REST

[75] Inventor: Terry B. Christensen, Jr., Sunnyvale, Calif.

[73] Assignee: Steelcase Inc., Grand Rapids, Mich.

[21] Appl. No.: 712,506

[22] Filed: Jun. 10, 1991

[51] Int. Cl.[5] ..... A47C 7/50

[52] U.S. Cl. ..... 297/439; 297/345; 248/394

[58] Field of Search ..... 297/439, 423, 438; 248/394, 157, 912; 108/116, 7, 143, 148, 145

[56] References Cited

U.S. PATENT DOCUMENTS

| | | | |
|---|---|---|---|
| D. 92,703 | 7/1934 | Crego . | |
| D. 157,493 | 2/1950 | Hood et al. . | |
| D. 313,521 | 1/1991 | Hassel et al. . | |
| 986,131 | 3/1911 | Braasch | 108/116 X |
| 2,593,623 | 4/1952 | Stempel . | |
| 3,132,835 | 5/1964 | Drabert | 297/439 |
| 3,653,715 | 4/1972 | Drabert et al. . | |
| 3,890,660 | 6/1975 | Pedler . | |
| 4,064,580 | 12/1977 | Ezekoye . | |
| 4,228,745 | 10/1980 | Gale . | |
| 4,287,835 | 9/1981 | Stratton . | |
| 4,441,758 | 4/1984 | Fleischer et al. . | |
| 4,539,977 | 9/1985 | Schneider, Sr. | 297/439 X |
| 4,549,767 | 10/1985 | Hampshire et al. . | |
| 4,592,528 | 6/1986 | Still . | |
| 4,678,234 | 7/1987 | Wilson . | |
| 4,692,954 | 9/1987 | Scott, Sr. . | |
| 4,991,908 | 2/1991 | Krechel . | |

FOREIGN PATENT DOCUMENTS

| | | | |
|---|---|---|---|
| 3308345 | 9/1984 | Fed. Rep. of Germany | 108/116 |
| 3728717 | 3/1989 | Fed. Rep. of Germany | 297/439 |

OTHER PUBLICATIONS

Advertisement entitled "Foot Rest".

Advertisement entitled "Foot Ease Adjustable Foot Rest".

Advertisement entitled "New! Footrest".

*Primary Examiner*—Peter R. Brown

*Attorney, Agent, or Firm*—Price, Heneveld, Cooper, DeWitt & Litton

[57] ABSTRACT

An adjustable foot rest includes an elliptically-shaped foot pad having an upper surface and lateral sides. A pair of legs are eccentrically pivoted to the sides of the foot pad. Rotation of the legs provides a plurality of different height positions for the foot pad. A ratchet mechanism between the legs and the pad restricts rotation of the legs to a single direction.

24 Claims, 2 Drawing Sheets

FOOT REST

BACKGROUND OF THE INVENTION

The present invention relates to foot rests and more particularly to an adjustable foot rest, capable of supporting a user's feet at proper ergonomic heights and tilt angles.

The introduction of electronic data processing equipment, personal computers and word processing equipment in the office environment has increased the importance of proper posture and ergonomic fitting of equipment to the user. For example, keyboard supports are now provided which adjustably position the keyboard with respect to the user. In addition, office seating typically provides height and tilt adjustment. Also, a fairly wide variety of foot rests, or foot supports are presently available. Foot rests are provided to support the user's feet in an elevated and inclined position. Such support reduces fatigue, leg strain and lower back discomfort which is associated with extended periods of sitting.

A fixed position foot rest provides adequate or proper support for only a limited, average portion of the total population. Supports which are adjustable as to height and tilt angle are necessary to accommodate a wide range of users. Different attempts have been made to provide an adjustable foot rest. The available foot rests suffer from various problems, including complexity, difficulty in manufacture and use, and relatively high cost. Examples of prior adjustable foot rests may be found in U.S. Pat. No. 4,441,758 entitled ADJUSTABLE FOOT SUPPORT, issued on Apr. 10, 1984 to Fleischer and U.S. Pat. No. 4,549,767 entitled ADJUSTABLE FOOT SUPPORT, issued on Oct. 29, 1985 to Hampshire et al.

A need exists for an adjustable foot rest or foot support, which is reliable, relatively easy to use, adjustable in height and tilt and adaptable to a wide range of users, yet which is relatively easy and inexpensive to manufacture.

SUMMARY OF THE INVENTION

In accordance with the present invention, the aforementioned need is fulfilled. Essentially, an adjustable foot rest is provided which includes a foot pad having an upper surface and lateral sides. A pair of legs are pivoted to the lateral sides of the foot rest. Rotation of the legs provides for mechanical height adjustment of the foot pad upper surface.

In narrower aspects of the invention, the upper surface of the foot pad has an elliptical shape in side elevation. The elliptical shape allows the user to place his or her feet at angles from 0° to 22° at each of the mechanical height and tilt positions. Further, a ratchet mechanism is included to restrict rotation of the legs to one direction only.

The adjustable foot rest in accordance with the present invention provides for multiple height and tilt adjustments. Varying tilt angles are provided by a combination of mechanical height positions and the elliptical shape of the foot pad. The assembly is easy to use. The assembly is relatively inexpensively manufactured and reliable in operation.

DETAILED DESCRIPTION OF THE PREFERRED EMBODIMENT

Figure 1:
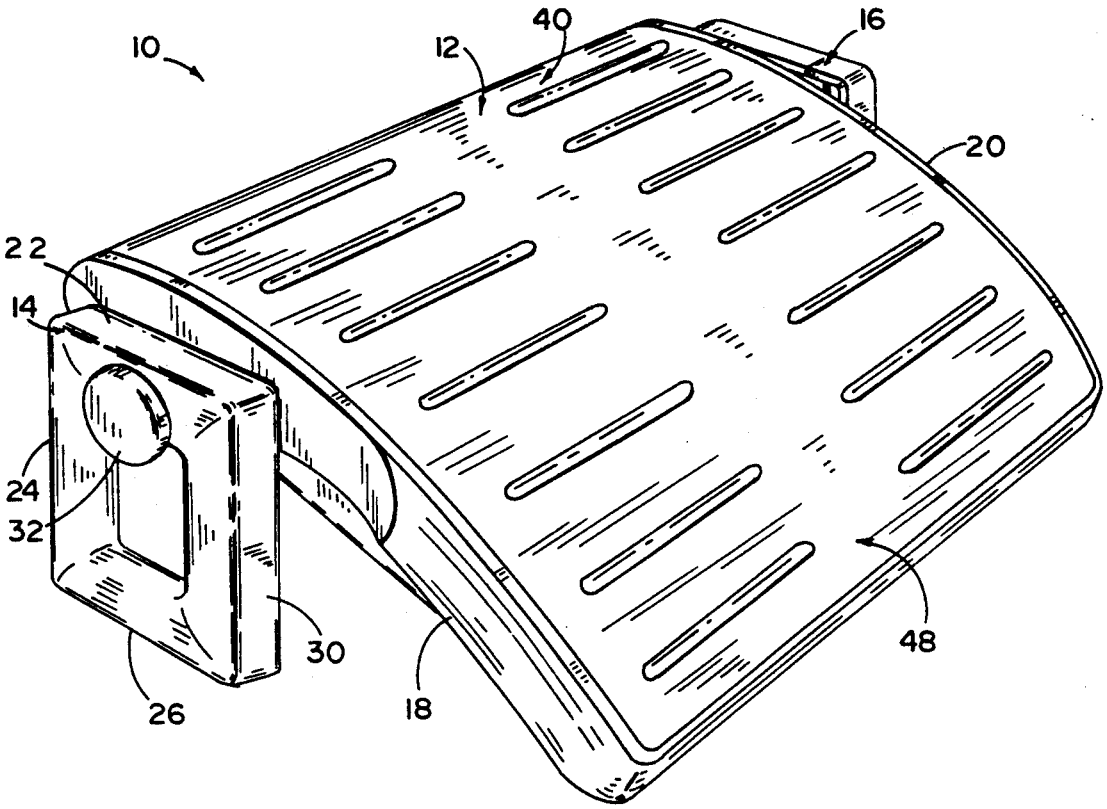
FIG. 1 is a perspective view of an adjustable foot rest in the present invention.

A foot rest, in accordance to the present invention, is illustrated in FIG. 1 and generally designated by the numeral 10. Foot rest 10 includes a foot pad assembly 12 and a pair of rotatable legs 1 4, 16. As described in more detail below, legs 14, 16 are rotatably mounted at lateral sides 18, 20 of foot pad assembly 12. Each leg 14, 16 is generally rectangular in shape. Each leg includes lateral sides 22, 24, 26, 30. Caps 32 may also be included. Legs 14, 16 rotate together so that they both may be selectively positioned on the floor surface on one of the lateral sides 22, 24, 26, 30. In this fashion, mechanical height adjustment of foot pad assembly 12 is provided.

Figure 2:
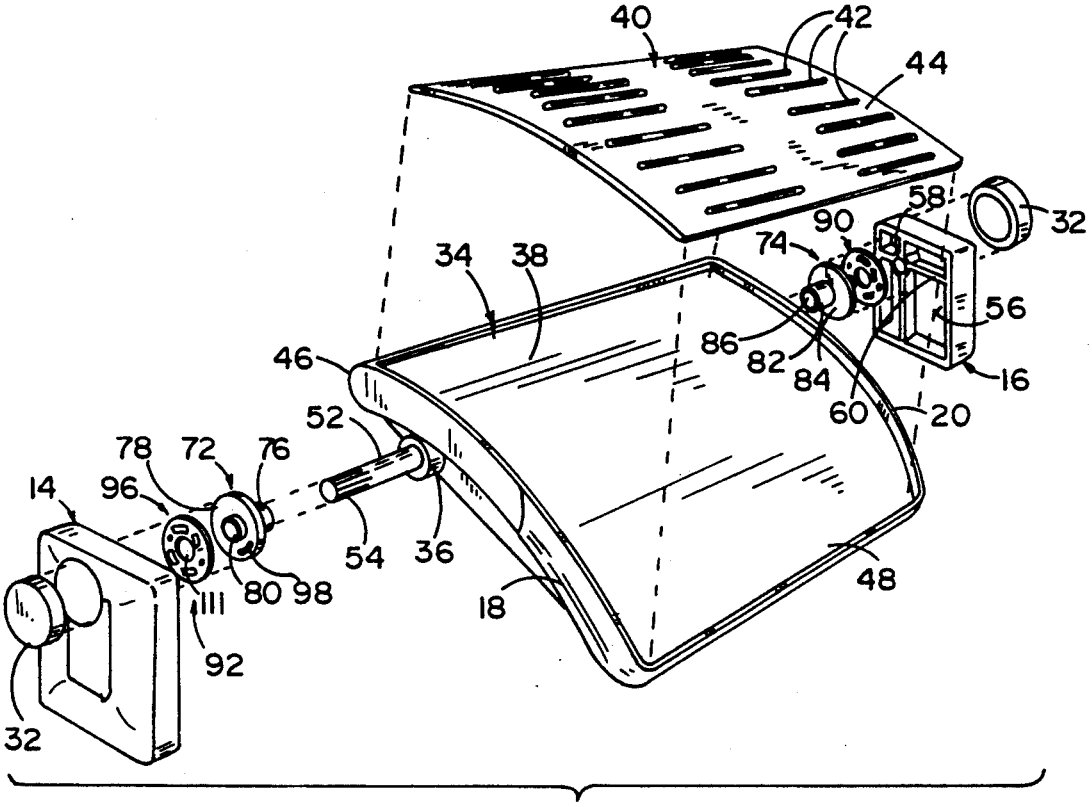
FIG. 2 is an exploded assembly view of the foot rest.

As best seen in FIGS. 1 and 2, foot pad subassembly 12 includes a molded plastic housing 34. Housing 34 defines a pair of bosses 36. Bosses 36 are molded integral at lateral sides 18, 20 of the foot pad assembly. Housing 34 defines an upper surface 38 which is recessed inwardly. A foot pad mat 40 is positioned within the recessed upper surface. Mat 40 defines nonslip bars 42 on its upper surface 44. Pad 40 is secured to housing 34 by a suitable adhesive. It is presently preferred that housing 34 be injection molded from an engineering plastic. Pad 40 is fabricated from a limited slip or rubberized pad-like material.

As seen in FIGS. 1 and 2, foot pad assembly 12 including housing 34 has an elliptical shape in side elevation. The elliptical shape allows the users to place their feet at angles from 0° at the upper portion 46 of housing 34 to approximately 22° at the bottom or lower portion 48. The available foot angles are provided at all mechanical height/tilt positions of the foot rest assembly.

An elongated shaft 52 extends between and through lateral sides 18, 20 of foot pad assembly 12. Shaft 52 extends through bosses 36 defined by the lateral sides of the foot pad housing. Each end 54 of shaft 52 may be knurled as seen in FIG. 2. Each leg 14, 16 is of identical construction with the legs being mirror images of each other. Legs 14, 16 are preferably molded from an engineering plastic material. An inner surface 56 of each leg defines a molded boss 58. Reinforcement ribbing 60 may be also provided. Boss 58 is located eccentrically of the lateral and vertical centerlines of each leg. As a result, the distances between boss 58 and each lateral side 22, 24, 26, 30 are different. Ends 54 of shaft 52 are fitted into bosses 58. In the alternative and as presently preferred, ends 54 of shaft 52 have a square cross section. Bosses 58 are also square in shape to receive ends 54. Legs 14, 16 are nonrotatably secured to shaft 52. Rotation of one leg, therefore, rotates the shaft and the remaining leg.

Shaft 52 is supported on foot pad housing 34 by bushings 72, 74. Each bushing 72 includes a hub portion 76 and a circular flange 78. Hub 76 defines a bore 80. Bushing 74 similarly includes a cylindrical hub portion 82, a circular flange 84 and a hub bore 86. Hubs 76, 82 are fitted into bosses 36 defined by foot pad housing 34. Shaft 52 extends through passages 80, 86 defined by the bushings. The bushings support shaft 52 for rotation within the housing. A Belleville or spring washer 90 is positioned on shaft 52 between leg 16 and bushing 74. A ratchet mechanism 92 is supported on shaft 52 at leg 14.

Figure 3:
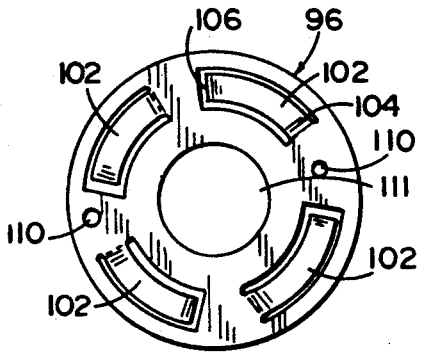
FIG. 3 is an elevational view or a ratchet member or detent washer incorporated in the present invention.
Figure 4:
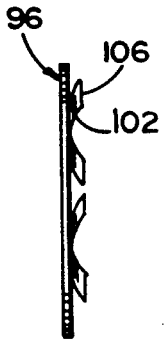
FIG. 4 is a side elevational view of the detent washer of FIG. 3.
Figure 5:
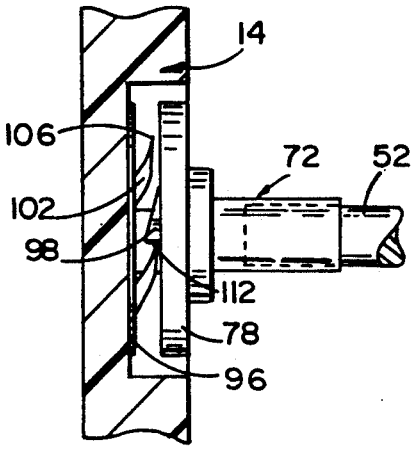
FIG. 5 a fragmentary partially sectioned view schematically illustrating the operation of the ratchet mechanism incorporated in the present invention.

Ratchet mechanism 92 includes a ratchet or detent washer 96 and a ramp or pawl 98 on bushing 72. As best seen in FIGS. 3, 4 and 5 detent washer or ratchet member 96 is a generally circular disc-like member formed with a plurality of axially-extending leaf springs or ratchet teeth 102. Teeth 102 are integral with and flexibly joined or hinged to ratchet member 96 at ends 104. Opposite ends 106 of each ratchet 102 are freefloating. Leaf springs 102 are positioned spaced circumferentially around the disc at positions corresponding to the lateral sides 22, 24, 26 and 30 of legs 14. In addition, ratchet member 96 defines apertures 110, 112. Disc 96 is secured to leg 14 by suitable fasteners passing through apertures 110. A center aperture 111 is also included for shaft 52. Disc 96 will, therefore, rotate with axle 52 and legs 14, 16.

As seen in FIGS. 2 and 5, pawl 98 is an angled ramp formed on flange 78 of bushing 72. Bushing 72, since it is press-fitted to foot pad housing 34, is fixed with respect to the housing. As is apparent from FIG. 5, leg 14 may be rotated in one direction with leaf springs or ratchets 102 riding up and over ramp 98. Disc or ratchet member 96 is preferably fabricated from stainless steel. The fingers have spring memory so that they flex as they move over ramp 98. Upon reverse rotation of leg 14, one of the ratchet teeth 102 will engage a vertical end 112 of ramp 98. Since bushing 72 is fixed with respect to pad subassembly 12, reverse rotation of leg 14 and hence axle 52 and leg 16 is prevented. Spring 90, adjacent leg 16, loads the assembly, accommodates manufacturing tolerances and insures that ratchet fingers 102 are in contact with flange 78 and ramp 98 of bushing 72.

The foot rest in accordance with the present invention accommodates a wide variety of physical characteristics of potential users. Four mechanical height positions are provided by legs 14, 16. It is presently preferred that the legs be dimensioned and axle bosses 58 positioned so that height positions of 3.1 inches, 3.9 inches, 4.4 inches and 6 inches are provided. The foot print area of the assembly is approximately 16 inches wide by 12.7 inches deep from front to back. The total width of the foot rest is approximately 18.5 inches.

Tilt positioning of the upper surface of the pad assembly as provided by the mechanical height positions and the elliptical shape of the foot pad housing. The elliptical shape allows the user to place his or her feet at angles from 0° to 22° at all four mechanical height/tilt positions. A smooth pivot action is provided since the shaft 52 rides within hub portions 76, 82 of bushings 72, 74. Operation is simplified from prior devices. The legs and shaft are permitted to rotate in only one direction. Rotation of one leg rotates both legs. Additional anti-skid characteristics may be provided by the application of a rubberized material to lateral sides 22, 24, 26, 30 of legs 14, 16 as well as of the undersurface of front portion 48 of the foot pad subassembly 12 where the subassembly contacts the floor. Foot pad mat 40 is preferably manufactured from compression molded nitrile (Buna-N). The foot pad housing 34 is preferably manufactured from a structural plastic, such as an injection molded ABS. The legs are manufactured from an injection molded ABS. The axle 52 is fabricated from cold-rolled steel. Bushings 72, 74 are preferably fabricated from injection molded nylon 6/6. Ratchet member 96 and spring washer 90 are stamped from stainless steel.

In view of the above description, those of ordinary skill in the art may envision various modifications which would not depart from the inventive concepts disclosed herein. It is expressly intended, therefore, that the above description should be considered as only that of the preferred embodiment. The true spirit and scope of the present invention may be determined by reference to the appended claims.

I claim:

1. An adjustable foot rest, comprising:

a foot pad having an upper surface and lateral sides, said upper surface having an elliptical shape inside elevation along said lateral sides to permit users to place their feet at different foot angles throughout the length of said pad;

a pair of rectangular legs, each leg having four sides; and pivot means operatively connected to said legs for eccentrically mounting and pivoting said legs to said lateral sides of said foot pad whereby said upper surface may be adjusted with respect to ground to four different height positions corresponding to which sides of the rectangular legs are in contact with the ground upon pivoting of said legs.

2. An adjustable foot rest as defined by claim 1 wherein said pivot means comprises:

an elongated shaft rotatably mounted on said foot pad, said shaft having ends receiving said legs.

3. An adjustable foot rest as defined by claim 2 wherein said legs are each eccentrically mounted to an end of said shaft.

4. An adjustable foot rest, comprising:

a foot pad having an upper surface and lateral sides;

a pair of legs, each leg having sides; and pivot means operatively connected to said legs for pivoting said legs to said lateral sides of said foot pad whereby the height of said upper surface may be adjusted with respect to ground by placing different sides of the legs in contact with the ground, said pivot means comprising:

an elongated shaft rotatably mounted on said foot pad, said shaft having ends receiving said legs, wherein said legs are each eccentrically mounted to an end of said shaft and said pivot means further includes ratchet means between at least one of said legs and said foot pad for permitting pivotal movement of said legs in only one direction.

5. An adjustable foot rest as defined by claim 4 wherein said ratchet means comprises:

a ratchet member defining a plurality of teeth, said ratchet member being fixed to one of said legs and said foot pad; and a pawl fixed to the other of said legs and said foot pad, said teeth and said pawl configured so that said teeth pass over said pawl upon rotation in one direction but engage said pawl upon rotation in the other direction.

6. An adjustable foot rest as defined by claim 5 wherein said ratchet member comprises:

a generally circular disc having a center aperture through which said shaft passes, said disc defining a plurality of axially-extending spaced leaf members which define said teeth.

7. An adjustable foot rest as defined by claim 6 wherein said pawl comprises a bushing having a hub, a flange and a ramp on said flange, said ramp facing said ratchet member.

8. An adjustable foot rest as defined by claim 7 wherein said pivot means further comprises:

a spring on said axle, said spring being positioned between one of said legs and said foot pad.

9. An adjustable foot rest as defined by claim 8 wherein said foot pad defines a boss through which said axle passes and wherein said hub of said bushing is fitted into said boss.

10. An adjustable foot rest as defined by claim 9 wherein said ratchet member is fixed to one of said legs and said pawl is fixed to said foot pad.

11. An adjustable foot rest as defined by claim 10 wherein each of said legs is generally rectangular in shape.

12. An adjustable foot rest as defined by claim 11 wherein said legs each define an eccentrically positioned shaft boss, said boss positioned so that said foot pad can be positioned at four different heights corresponding to four different positions of said legs.

13. An adjustable foot rest as defined by claim 12 wherein said foot pad has an elliptical shape in side elevation.

14. An adjustable foot rest, comprising:

a foot pad having an upper surface and lateral sides;

a pair of legs; and pivot means operatively connected to said legs for pivoting said legs to said lateral sides of said foot pad so that the height of said upper surface may be adjusted, each of said legs being generally rectangular in shape and wherein said pivot means comprises:

an elongated shaft rotatably mounted on said foot pad, said shaft having ends receiving said legs and wherein said legs each define an eccentrically positioned shaft boss, said boss positioned so that said foot pad can be positioned at four different heights corresponding to four different positions of said legs.

15. An adjustable foot rest as defined by claim 14 wherein said pivot means further includes ratchet means between at least one of said legs and said foot pad for permitting pivotal movement of said legs in one direction only.

16. An adjustable foot rest as defined by claim 15 wherein said ratchet means comprises:

a ratchet member defining a plurality of teeth, said ratchet member being fixed to one of said legs; and a pawl fixed to said foot pad, said teeth and said pawl member configured so that said teeth pass over said pawl upon rotation in one direction but engage said pawl upon rotation in the other direction.

17. An adjustable foot rest as defined by claim 16 wherein said ratchet member comprises:

a generally circular disc having a center aperture through which said shaft passes, said disc defining a plurality of axially-extending spaced leaf springs which define said teeth.

18. An adjustable foot rest as defined by claim 17 wherein said pawl comprises a bushing having a hub, a flange and a ramp on said flange, said ramp facing said ratchet member.

19. An adjustable foot rest as defined by claim 18 wherein said pivot means further comprises:

a spring on said axle, said spring being positioned between one of said legs and said foot pad.

20. An adjustable foot rest as defined by claim 19 wherein said foot pad defines a boss through which said axis passes and wherein said hub of said bushing is press-fitted into said boss.

21. A foot support for use at a workstation, said support comprising:

a foot pad having an upper surface, said pad having an elliptical shape in side elevation along the entire length of said upper surface to permit users to place their feet at different foot angles within a range of zero degrees at an upper portion of the surface to a maximum angle at a lower portion of the surface; and height adjustment means operably connected to said foot pad for varying the height of said pad upper surface with respect to ground, said height adjustment means comprising:

a leg having sides; and pivot means engaging the leg for eccentrically mounting and for pivoting said leg to said foot pad, whereby pivoting of said leg to place a different side thereof into contact with the ground changes the height of said upper surface.

22. A foot support for use at a workstation, said support comprising:

a foot pad having an upper surface, said pad having an elliptical shape inside elevation; and height adjustment means operably connected to said foot pad for varying the height of said pad upper surface with respect to ground, said height adjustment means comprising:

a leg having sides; and pivot means engaging the leg for pivoting said leg to said foot pad, and wherein said pivot means comprises:

a shaft; and ratchet means connected to said leg for permitting pivot movement of said leg in only one direction whereby pivoting of the leg to place a different side thereof in contact with the ground changes the height of said pad upper surface.

23. A foot support as defined by claim 22 wherein said ratchet means comprises a ratchet member on said leg, said member defining a plurality of axially-extending ratchet springs; and a ramp fixed with respect to said pad, said springs riding over said ramp upon rotation of said leg in one direction.

24. A foot support as defined by claim 23 wherein said leg defines an eccentrically positioned boss which receives said shaft.

* * * * *

UNITED STATES PATENT AND TRADEMARK OFFICE

CERTIFICATE OF CORRECTION

PATENT NO. : 5,201,568

DATED : April 13, 1993

INVENTOR(S) : Terry B. Christensen, Jr.

It is certified that error appears in the above-identified patent and that said Letters Patent is hereby corrected as shown below:

Column 2, Line 2;
"or" should be --of--.

Column 5, Claim 8, Line 5;
"axle" should be --shaft--.

Column 5, Claim 9, Line 9;
"axle" should be --shaft--.

Column 6, Claim 19, Line 7;
"axle" should be --shaft--.

Column 6, Claim 20, Line 11;
"axis" should be --shaft--.

Signed and Sealed this

Twenty-sixth Day of April, 1994

*Attest:*

*Attesting Officer*

BRUCE LEHMAN

*Commissioner of Patents and Trademarks*